US005590468A

United States Patent [19]

Prochaska

[11] Patent Number: 5,590,468

[45] Date of Patent: Jan. 7, 1997

[54] MOVABLE BLADE SHAVING CARTRIDGE WITH CONDITIONING BAR

[75] Inventor: Frank H. Prochaska, Waynesboro, Va.

[73] Assignee: American Safety Razor Company, Verona, Va.

[21] Appl. No.: 472,294

[22] Filed: Jun. 7, 1995

Related U.S. Application Data

[63] Continuation-in-part of Ser. No. 247,225, May 23, 1994, which is a continuation-in-part of Ser. No. 46,989, Apr. 16, 1993, Pat. No. 5,341,571.

[51] Int. Cl.[6] ..... B26B 21/06

[52] U.S. Cl. ..... 30/41; 30/50

[58] Field of Search ..... 30/47–50, 346.5, 30/34.2, 77, 81–83

[56] References Cited

U.S. PATENT DOCUMENTS

| | | | |
|---|---|---|---|
| Re. 30,913 | 4/1982 | Cartwright et al. | 30/47 |
| 2,040,345 | 5/1936 | Taylor | 30/34 |
| 2,068,085 | 1/1937 | Stanley | 30/34 |
| 2,548,959 | 4/1951 | Eisenberg et al. | 30/34 |
| 2,766,521 | 10/1956 | Benvenuti | 30/34 |
| 3,138,865 | 6/1964 | Meyer | 30/34 |
| 3,939,560 | 2/1976 | Lyall | 30/34.2 |
| 4,069,580 | 1/1978 | Cartwright et al. | 30/47 |
| 4,126,601 | 11/1978 | Cartier | 260/42.27 |
| 4,168,571 | 9/1979 | Francis | 30/47 |
| 4,189,832 | 2/1980 | Harper et al. | 30/34.2 |
| 4,251,914 | 2/1981 | Grosjean | 30/32 |
| 4,270,268 | 6/1981 | Jacobson | 30/47 |
| 4,302,876 | 12/1981 | Emmett | 30/47 |
| 4,335,508 | 6/1982 | Francis et al. | 30/47 |
| 4,389,773 | 6/1983 | Nissen et al. | 30/50 |
| 4,403,412 | 9/1983 | Trotta | 30/47 |
| 4,409,735 | 10/1983 | Cartwright et al. | 30/47 |
| 4,443,939 | 4/1984 | Motta et al. | 30/49 |
| 4,443,940 | 4/1984 | Francis et al. | 30/50 |
| 4,459,744 | 7/1984 | Esnard | 30/49 |
| 4,461,079 | 7/1984 | Ciaffone et al. | 30/79 |
| 4,502,217 | 3/1985 | Schachter | 30/82 |
| 4,516,320 | 5/1985 | Peleckis | 30/49 |
| 4,535,537 | 8/1985 | Ferraro et al. | 30/32 |
| 4,574,476 | 3/1986 | Ortiz | 30/47 |
| 4,709,477 | 12/1987 | Ferraro | 30/50 |
| 4,720,917 | 1/1988 | Solow | 30/49 |
| 4,741,103 | 5/1988 | Hultman | 30/34.2 |
| 4,845,848 | 7/1989 | Strickland | 30/49 |
| 4,854,043 | 8/1989 | Chen | 30/50 |
| 4,893,641 | 1/1990 | Strickland | 132/200 |
| 4,932,122 | 6/1990 | Shurland et al. | 30/50 |
| 4,942,662 | 7/1990 | Radcliffe | 30/49 |
| 4,964,214 | 10/1990 | Welsh et al. | 30/49 |
| 4,976,028 | 12/1990 | Chen | 30/49 |
| 4,993,154 | 2/1991 | Radcliffe | 30/85 |

(List continued on next page.)

*Primary Examiner*—Douglas D. Watts
*Attorney, Agent, or Firm*—McDermott, Will & Emery

[57] ABSTRACT

A movable blade cartridge including a platform member having a blade seat and a guard member. The guard member is located of forward and parallel to the blade seat so as to form a longitudinal slot between the blade seat and the guard member. A primary blade which is disposed on the blade seat such that the cutting edge of the blade is located rearwardly of the guard member. A substantial portion of the primary blade extends into the slot formed between the guard member and the blade seat such that the blade is flexible into the slot. The guard member further comprises a plurality of upwardly extending protrusions which function as a conditioning bar and engage the shaving surface prior to the shaving process. A spacer is located on the upper surface of the primary blade. The spacer comprises a rear portion which functions to separate the primary blade and a secondary blade, as well as a forward portion which extends from the rear portion and functions to prevent upward movement of the primary blade, and create an opening beneath the forward portion of the spacer and the lower surface of the secondary blade. Both the primary and secondary blade are manufactured and mounted so as to be flexible in response to forces encountered during the shaving operation.

18 Claims, 15 Drawing Sheets

U.S. PATENT DOCUMENTS

| | | | |
|---|---|---|---|
| 5,003,694 | 4/1991 | Chen | 30/49 |
| 5,031,316 | 7/1991 | Oldroyd | 30/47 |
| 5,056,222 | 10/1991 | Miller et al. | 30/77 |
| 5,067,238 | 11/1991 | Miller et al. | 30/34.002 |
| 5,074,042 | 12/1991 | Althaus et al. | 30/50 |
| 5,185,927 | 2/1993 | Rivers | 30/50 |
| 5,191,712 | 3/1993 | Crook et al. | 30/34.2 |
| 5,199,173 | 4/1993 | Hegemann et al. | 30/49 |
| 5,205,040 | 4/1993 | Werner | 30/50 |
| 5,222,300 | 6/1993 | Althaus et al. | 30/50 |
| 5,224,267 | 7/1993 | Simms et al. | 30/50 |
| 5,249,361 | 10/1993 | Apprille, Jr. et al. | 30/77 |
| 5,251,376 | 10/1993 | Althaus et al. | 30/50 |
| 5,253,420 | 10/1993 | Althaus et al. | 30/50 |
| 5,313,706 | 5/1994 | Motta et al. | 30/57 |
| 5,347,716 | 9/1994 | Crook | 30/77 |
| 5,388,332 | 2/1995 | Oldroyd | 30/50 |

MOVABLE BLADE SHAVING CARTRIDGE WITH CONDITIONING BAR

This application is a Continuation-In-Part of application Ser. No. 08/247,225, filed May 23, 1994 which is a Continuation-In-Part of application Ser. No. 08/046,989, filed Apr. 16, 1993 now U.S. Pat. No. 5,341,571.

BACKGROUND OF THE INVENTION

The present invention relates to wet shaving systems of the blade type and more particularly to a shaving system having a movable blade positioned within a blade cartridge or the like.

During the shaving process, shavers have long sought a wet shaving system which provides a smooth and comfortable shave without having annoying cuts and abrasions. In order to accomplish this objective, it has been known in the art to utilize multiple blade shaving systems which provide independent movement of the blades relative to the blade cartridge. (See, U.S. Pat. No. 4,168,571).

Typically, such shaving systems include two blades disposed parallel to one another so as to provide first and second cutting edges which successively engage the shaving surface in a predetermined spaced relationship. The use of multiple blades operates to provide a close, more efficient shave. Further, the independent movable blades permit the shaving geometry of each blade to adapt to the various conditions encountered during the shaving process in an effort to reduce nicks and cuts.

The terms utilized to define the various geometric relationships between the blades, the various elements of the blade cartridge and the shaving surface include "shaving plane", "blade exposure" and "shaving angle". The term "shaving plane" means the plane tangent to skin engaging surfaces, for example a guard and a cap, which are disposed on both sides of the blade so as to engage the shaving surface before and after engagement by the blade. The term "blade exposure" means the distance by which the blade edge projects forwardly of the shaving plane. Finally, the term "shaving angle" means the acute angle between the plane tangent to the cutting edge of the blade and the shaving plane.

Various approaches have been used to enable the shaving blade to move relative to the blade cartridge or razor body in response to shaving forces encountered during the shaving process in an effort to present the correct blade exposure and shaving angle.

One approach disclosed in prior art patents illustrates a blade cartridge comprising two blades separated by a spacer with the blades and the spacer attached to a cap to form a unitary assembly. The blade assembly is movable between various blade exposures and shaving angles within various degrees of control and direction in response to forces encountered during shaving. For example, Ciaffone et al., U.S. Pat. No. 4,461,079, discloses a razor cartridge comprising a body portion 10 which includes a guard bar 12 (FIGS. 1–5). The guard bar 12 defines a leading skin-engaging surface fixed to the body portion. A rear beam 17 spans end walls 14 and 16 of the body portion 10 and a medial support member 13 to join the front of the cartridge 12 to the end thereof. A plurality of generally flat coplanar segments 18,19,21,22, each having an opening 23, are hinged to the rear beam 17 by mating webs 24,26,27,28 (col. 2, lines 50–52). Collectively, the segments 18,19,21,22 define a blade seat which is operable to pivot about the beam 17, thereby changing the attitude of blade edge relative to guard bar 12 (col. 2, lines 53–57). A cap 33 is apparently placed above an assembly of two skin-engaging blades 34,36, straddling a spacer 37 (FIG. 3). The two blades and the spacer are secured to one coplanar segment 21 of the blade support or blade seat by a conventional rivet 38 to form a rigid unit. A hinge 27 connects the coplanar segment 21 to the rear-beam 17 (col. 3, lines 1–8). As compared to the position of the blade edges relative to the guard bar at the normal or free position set in accordance with a predetermined blade geometry (FIG. 3), a change in blade geometry occurs during the course of shaving when a shaving force F causes the blade package to rotate or pivot about rear-beam 17 in the direction of arrow R where the blade edges are rendered less "aggressive" (FIG. 4, col. 3, lines 13–23). Upon relaxation of shaving forces, the elastic memory of hinges 24,26,27,28 forces the blade seat, and therefore the blade edges, to return to their normal position (FIG. 3., col. 3, lines 24–26).

In an alternative embodiment, Ciaffone et al. shows the blade seat is hinged to a front beam 175 by webs 240,260, 270,280 (FIGS. 6–10, col. 3, lines 46–48). Upon exertion of a shaving force F' (FIG. 9) onto the cap 330, the coplanar segments 180,190,210 and 220, move in the direction of the arrow R (FIG. 9) to provide a more aggressive edge exposure (col. 4, lines 1–9). As in the embodiment of FIGS. 1–5, the elastic memory of the hinges 240,260,270,280 forces the blade edges to return to the free position when shaving forces are released (col. 4, lines 11–13).

Oldroyd et al., U.S. Pat. No. 4,063,354, discloses a shaving unit wherein a blade unit comprises two blades separated by a spacer 5 (FIGS. 13–16). A resiliently flexible metallic or plastic guard 3 is secured to the blade unit by spot welding or other means (col. 3, lines 26–28). The blade unit, which is illustrated in its normal forward position of maximum blade exposure in FIG. 13, can bow rearwardly under pressure applied during shaving to carry the blade unit along a plane to the rear, relative to the platform 1 and cap 4. This reduces blade exposure but increases the shaving angle, as indicated by dotted lines 3' in FIGS. 13 and 15 (col. 3, lines 26–37).

Althauset et al., U.S. Pat. No. 5,074,042, discloses a shaver head comprising two staggered blades 7 embedded in a blade block 6 (FIG. 3). A cover cap portion 9 covers the top side of the blade block 6 (col. 3, lines 12–15). A spring 14 is placed between the blade block 6 and a body 2. The blade block 6, together with the two staggered blades 7, can swivel about an axis A (col. 3, lines 17–43). During shaving, pressure is applied to the razor blade unit, thereby causing the blade block 6 to swivel and alter shaving geometry of the blades (col. 3, lines 46–60).

Jacobson U.S. Pat. Nos. 4,442,598, 4,378,634 and 4,270, 268 disclose a razor blade assembly including a body member 2 having blade means 36,36' being independently movable in response to spring finger biasing means 18,18' integral with the body member. In the Jacobson patents, the spring fingers 18,18' move the blade means 36,36' along planes defined by slots 16 in end portions 4,6 of the body member 2.

In all of the aforementioned patents, the blade members either engage movable spring fingers formed integral with the blade cartridge, or are mounted permanently to a platform which is movably connected to the blade cartridge. These methods of providing a movable blade necessitate an elaborate and expensive molding procedure to create a blade cartridge having either integral spring fingers or a movable blade platform. While it has been noted that blades movable relative to the shaving surface during the shaving process are advantageous, it is desirable to eliminate the need for the elaborate molding process required by the movable blade assemblies of the prior art.

Additionally, prior art shaving systems have attempted to reduce the uncomfortableness in shaving caused by the frictional drag of the razor across the skin in conjunction with the force necessary to sever the hair protein structure or whisker. One known method of reducing the frictional drag is shown in U.S. Pat. No. 4,170,821 issued to Booth. As described in Booth, a lubricating agent commonly referred to as a "lube strip" is cemented to the cap portion of the blade cartridge to reduce the frictional forces between the razor and the skin.

However, such systems suffer from various drawbacks. First, a significant portion of the blade cartridge not containing any friction reducing agent remains in contact with the skin. For example, the ends of the blade cartridge extending perpendicular to the cutting edge remain in contact with the skin. As such, the frictional drag encountered during shaving remains significant. Second, the requirement of producing and cementing an additional "lube strip" to the blade cartridge increases manufacturing costs.

Moreover, prior art devices typically contained guards which would simply bend the hair and "squeegee" off all lubricants prior to actual cutting of the hair, thereby minimizing the usefulness of the lubricant.

SUMMARY OF THE INVENTION

The present invention provides a novel blade cartridge designed to satisfy the aforementioned needs. The invention embodies a plurality of blade members permanently fixed relative to the blade cartridge. Unlike the movable blade assemblies of the prior art, there are no movable support members in the blade cartridge of the present invention. Each blade is mounted such that a substantial portion of the blade is free from contact with support members. The free end of each blade functions as a single cantilever forming a "flexing zone" about which the cutting edge of the blade bends in response to an applied force. Each blade is flexible about the longitudinal axis of the blade. Thus, the present invention provides for individually movable blades without requiring an elaborate molding procedure to create movable spring fingers or movable blade platforms.

In addition, the present invention provides a guard member having raised protrusions which function to maximize the comfort and closeness of the shave without the associated nicks and cuts normally associated with twin blade shaving cartridges designed to shave close.

Accordingly, the present invention relates to a blade cartridge comprising a platform member having a blade seat and a guard member. The guard member is located forward of and parallel to the blade seat so as to form a longitudinal slot between the blade seat and the guard member. The blade cartridge also comprises a primary blade which is disposed on the blade seat such that the cutting edge of the blade is located rearwardly of the guard member. A substantial portion of the primary blade extends into the slot formed between the guard member and the blade seat such that the blade is flexible about the longitudinal axis of the blade into the slot. Preferably, the cutting edge of the primary blade is parallel to the guard member.

The blade cartridge also comprises a guard member having a plurality of protrusions disposed on the upper surface thereof. The guard member and the upwardly extending protrusions are formed as a single unitary member, preferable from a polypropylene material. The protrusions are aligned so as to form a single row, with each protrusion having substantially the same height. Furthermore, each protrusion has a substantially elongated oval shape, and extends perpendicularly to a front edge of the guard member.

The blade cartridge also comprises a cap member disposed on the secondary blade. The cap member comprises fastening means to secure the members forming the blade cartridge together, and a member which prevents upward movement of the secondary blade.

As described hereinafter, each blade is independently movable in response to shaving forces applied to the blade. Specifically, each blade is flexible about the longitudinal axis of the blade within a flexing zone defined by the ratio between the portion of the blade overlying a physical structure and the portion of the blade overlying the opening formed beneath the forward portion of each blade, in combination with the physical characteristics of the blade. If a force exceeding the resilient force of the blade is exerted on the blade, the blade flexes about the longitudinal axis so as to bend in the downward direction against the resilient force of the blade. The bending movement of the blade results in the simultaneously decrease of blade exposure and shaving angle.

Preferably, the blade cartridge is connected to a handle, and can be pivotally connected so as to allow the blade cartridge to further respond to shaving forces encountered during the shaving process.

The invention itself, together with further objects and advantages, will best be understood by reference to the following detailed description taken in conjunction with the accompanying drawings.

DETAILED DESCRIPTION OF THE INVENTION

Figure 1:
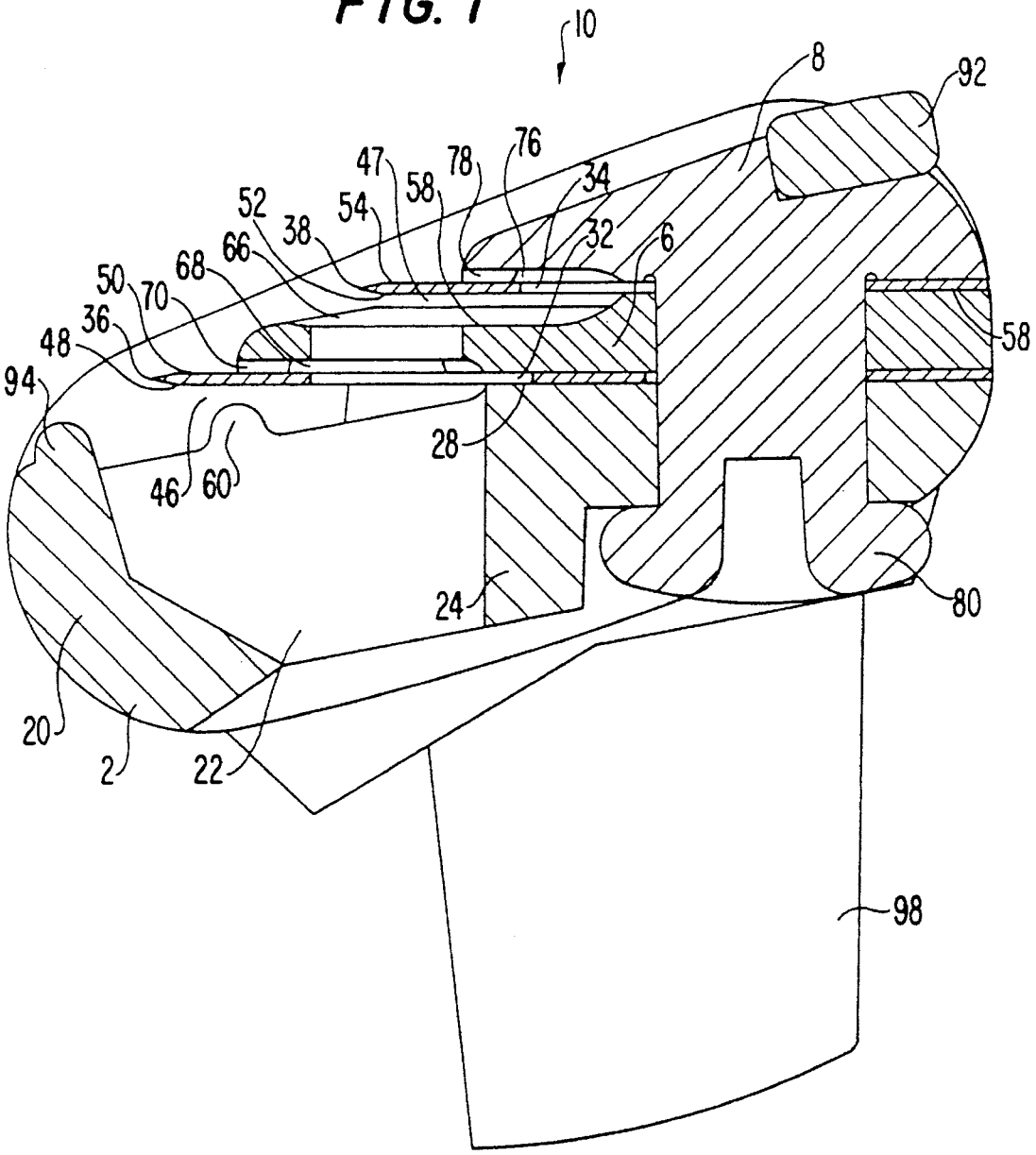
FIG. 1 is a cross-sectional view of the blade cartridge of the present invention through a rivet on the cap member illustrating the assembly with both the primary and secondary blade at rest.

Turning now to the drawings, FIGS. 1–13 illustrate a movable blade shaving cartridge ("MBSC" or blade cartridge) or razor head 10 which comprises a platform member 2, flexible blade means 32, 34, a spacer 6 and a cap member 8.

Figure 2:
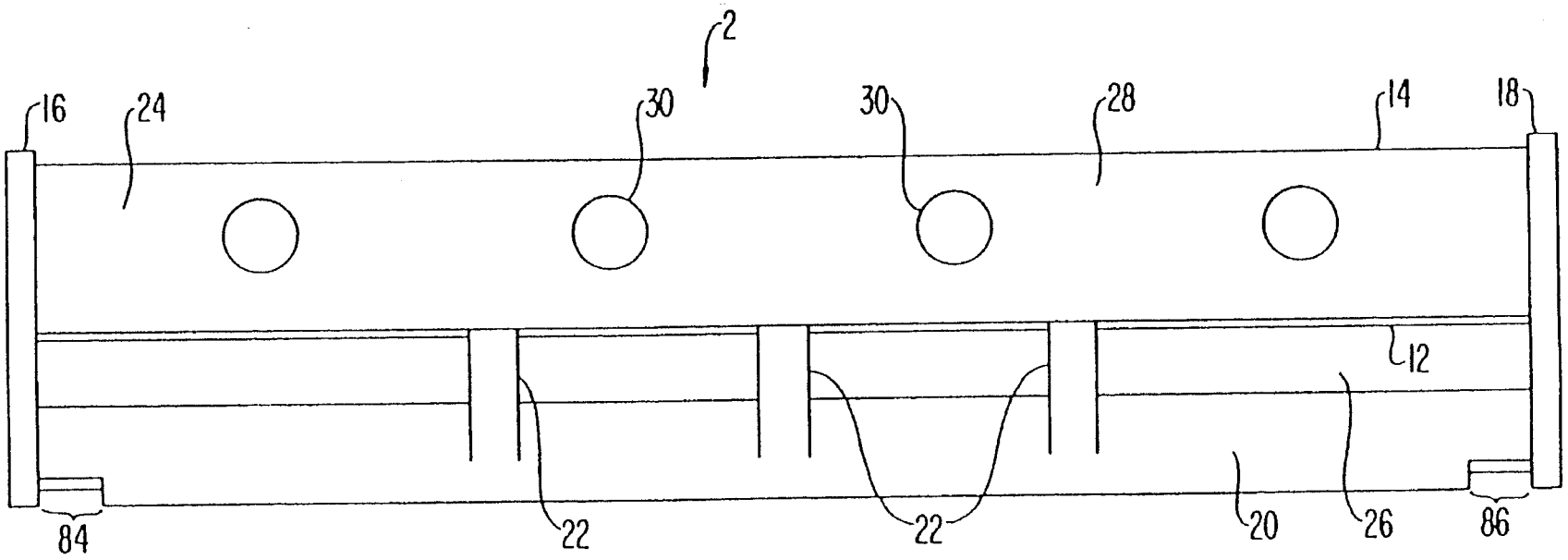
FIG. 2 illustrates a top plan view of the platform member of the present invention showing the blade seat, the guard member and a plurality of support members integrally molded to the blade seat and guard member.

As shown in FIG. 2, the platform member 2 comprises a blade seat 24 having a front and rear wall 12,14, and ends 16,18. The ends 16,18 extend beyond the front wall 12 so as to allow a guard member 20 to be interconnected between the ends 16,18 at a position forward of the front wall 12. The guard member 20 extends parallel to the front wall 12 forming a slot 26 between the guard member 20 and the front wall 12. The guard member 20 also is connected to the front wall 12 by a plurality of support members 22, which extend substantially perpendicular to the longitudinal axis of the both the guard member 20 and the front wall 12.

The blade seat 24 further comprises an upper surface 28, as well as a plurality of securing apertures 30. The securing apertures operate in conjunction with fastening means 80 located on the cap member 8, such as rivets, to permanently secure the platform member 2, the flexible blade means, the spacer 6 and the cap member 8 together.

The flexible blade means comprises a primary and secondary blade 32,34, each having substantially parallel front and rear edges with the front edge of each blade defining a cutting edge 36,38. Each blade 32,34 defines a longitudinal axis which is parallel to the cutting edge of the blade 32,34, and a lateral axis which is perpendicular to the cutting edge of the blade 32,34. Each blade 32,34 is flexible about its longitudinal axis.

Figure 8:
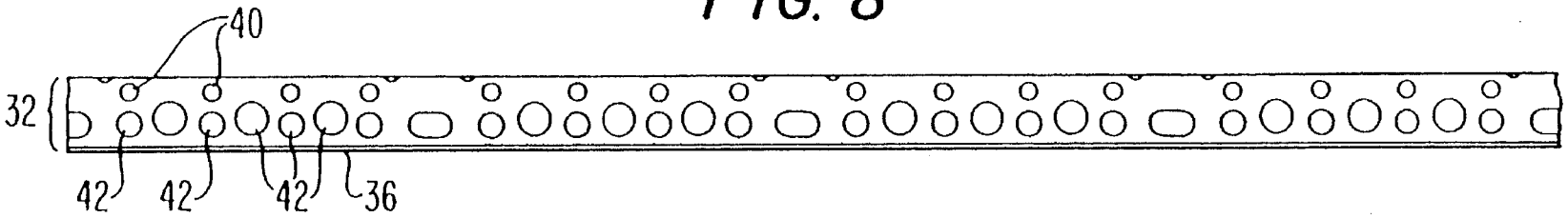
FIG. 8 illustrates a blade used for the primary blade structure.

As shown in FIG. 8, the primary blade 32 comprises securing apertures 40 which align with the securing apertures 30 of the blade seat 24 so as to allow the fastening means 80 to pass through the securing apertures 40 of the primary blade 32, thereby securing the primary blade 32 to the blade cartridge 10.

Figure 9:
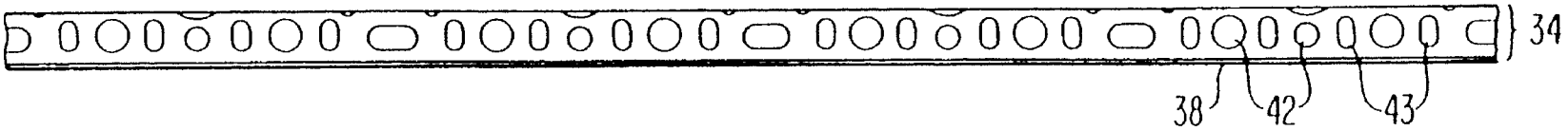
FIG. 9 illustrates a blade used for the secondary blade structure

The secondary blade 34 is illustrated in FIG. 9. Similar to the primary blade 32, the secondary blade 34 comprises securing apertures 43 which align with the securing apertures 30 of the blade seat 24 so as to allow the fastening means 80 to pass through the securing apertures 43 of the secondary blade 34, thereby securing the blade to the blade cartridge 10. However, the securing apertures 43 of the secondary blade 34 preferably are oval in shape and perform a dual function. The first function, which has already been stated, is to secure the secondary blade 34 to the blade cartridge 10. The second function of the apertures 43 is to contribute to the flexibility of the secondary blade 34. The secondary blade 34 is positioned such that the fastening means 80 passes through the rear portion of each securing aperture 43 (i.e. the portion farthest away from the cutting edge 38). As a result, the portion of the aperture 43 free from contact with the fastening means 80 contributes to the flexibility of the secondary blade 34.

Furthermore, both the primary and secondary blades 32,34 comprise a plurality of holes 42 located proximate the cutting edge 36,38 of the respective blade 32,34. The holes 42 provide a passage to facilitate the removal of shaving debris and contribute to the flexibility of the blades 32,34. Specifically, the diameter of the holes 42 in combination with the thickness of the blades 32,34 partially determines the degree of flexibility of the blades 32,34. Preferably, the sum of the longitudinal dimensions of the holes 42 on the primary blade 32 should be between 35 to 75 percent of the length of the blade. Similarly, the sum of the longitudinal dimensions of the apertures 43 and holes 42 on the secondary blade 34 should be between 35 to 75 percent of the length of the blade.

As shown in FIGS. 1 and 2, the support members 22 extend downwardly away from the upper surface 28 of the blade seat 24 so as to create a gap 46 between the lower surface 48 of the primary blade 32 and the upper surface of each support member 22. Preferably, each support member 22 also comprises a lip 60 which operates as a stop to prevent further downward movement of the primary blade 32.

Figure 4:
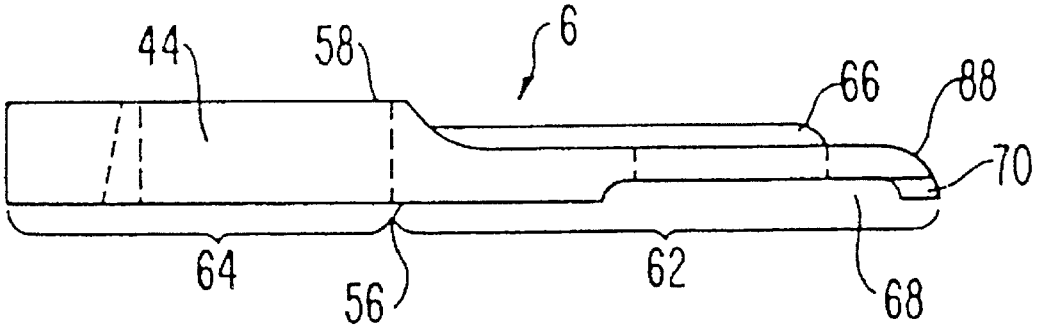
FIG. 4 illustrates an end view of the spacer shown in FIG. 3.

The spacer or "soap bar" 6, which is placed between the primary and secondary blades 32,34, functions to separate the blades 32,34. As shown in FIGS. 1 and 4, the spacer 6 comprises an upper and lower surface 58,56 and is divided into a forward portion 62 and a rear portion 64. The rear portion 64 of the spacer 6 exhibits a uniform height (i.e. the distance between the blades 32,34 measured perpendicularly to the longitudinal axis of the blades), so that when the blades 32,34 are secured to the upper and lower surface 58,56 of the spacer 6, respectively, the blades 32,34 are parallel to one another.

Preferably, as shown in FIG. 1, the primary blade 32 and the secondary blade 34 are separated from each other by a distance of about 0.020 inches to about 0.050 inches by the spacer 6. The height of the rear portion 64 of spacer 6 defines the separation between the two blades 32,34.

The forward portion 62 of the spacer 6 comprises portions having a reduced height relative to the rear portion 64 so as create areas where the blades 32,34 do not contact the spacer 6. Specifically, as shown in FIGS. 1 and 4, the upper surface 58 of the forward portion 62 exhibits an arcuate downward slope proximate the rear portion 64 and thereafter extends in the direction parallel to the plane of the blade 34. Furthermore, a plurality of ribs 66 are disposed on the upper surface 58 of the forward portion 62 of the spacer 6. The ribs 66 extend perpendicularly to the longitudinal axis of the blades 32,34 and exhibit a height such that the top of ribs 66 are below the plane of the upper surface 58 of the rear portion 64 of the spacer 6.

Figure 3:
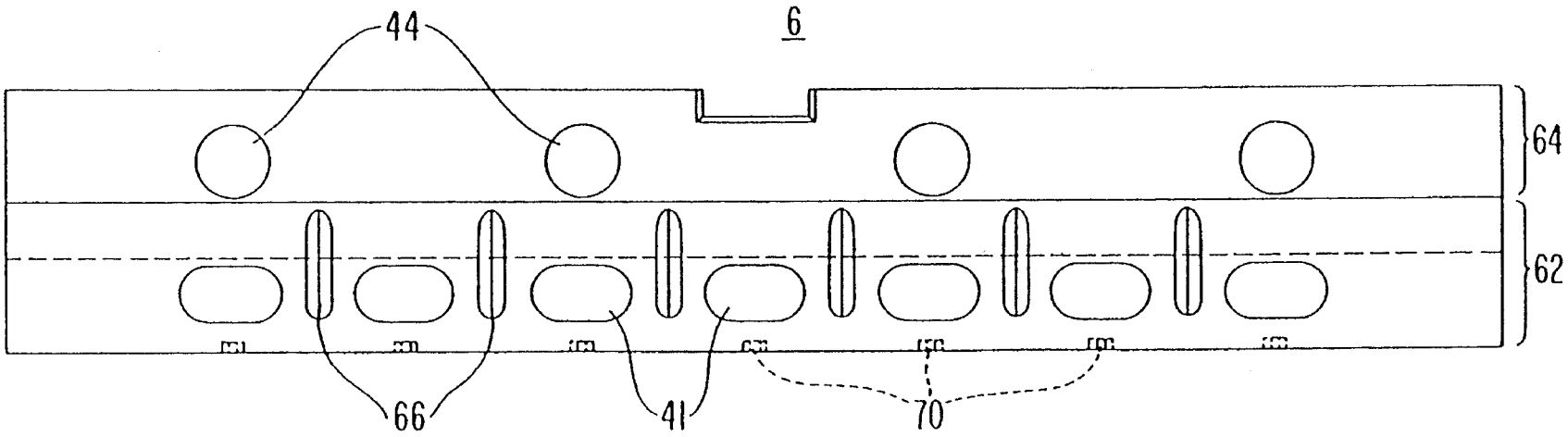
FIG. 3 illustrates a top plan view of a first embodiment of the spacer of to present invention.

The lower surface 56 of the forward portion 62 of the spacer 6 forms a cavity 68, which extends in a direction parallel to the cutting edge 36,38 of the blades 32,34. The lower surface 56 of the forward portion 62 of the spacer 6 further comprises a plurality of downwardly extending pads 70 on the outer edge of the forward portion 62 of the spacer 6. As shown in FIG. 3, the pads 70 are separated from one another so as to allow water to flow through the front of the spacer 6 into the cavity 68. Referring to FIG. 1, it is apparent that the primary blade 32 extends beyond the downwardly extending pads 70 of the spacer 6. As a result, the pads 70 operate as a stop limiting the upward movement of the primary blade 32.

Furthermore, similar to both blades 32,34, the spacer 6 comprises four securing apertures 44 which are located on the rear portion 64 of the spacer 6. The securing apertures 44 operate in conjunction with the fastening means 80 to secure the spacer 6 to the blade cartridge 10. The spacer 6 also comprises a plurality of holes 41 located on the forward portion 62 of the spacer 6, which align with the holes 42 of both the primary and secondary blades 32,34. The alignment of the spacer holes 41 and blade holes 42 allows water to be directed to the edges of both blades 32,34 so as to facilitate the removal of shaving debris.

Figure 5:
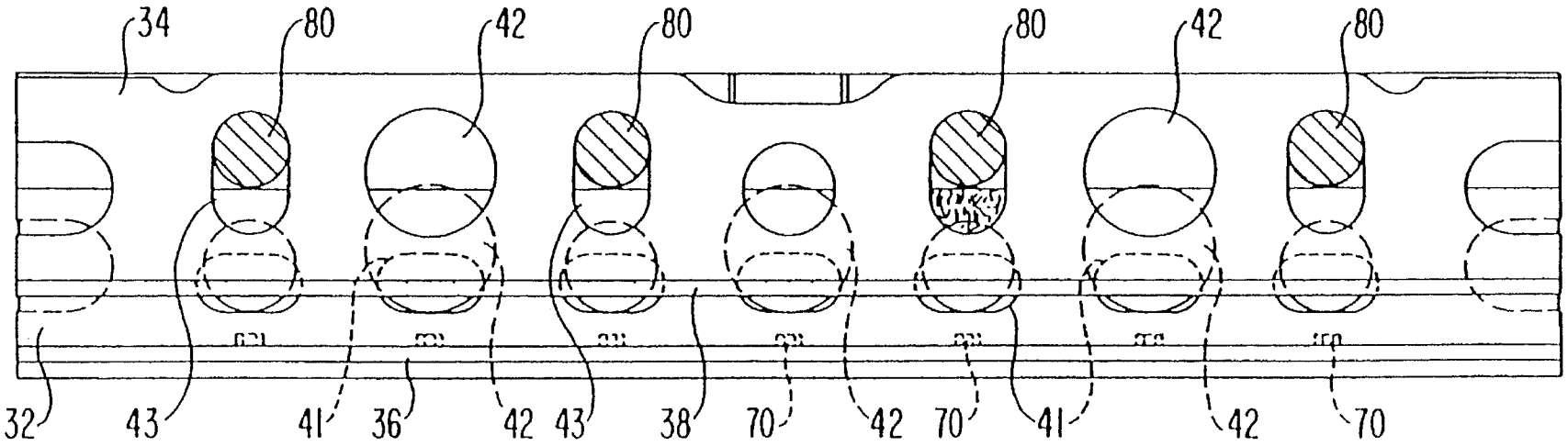
FIG. 5 illustrates a top plan view of the primary and secondary blade, and the spacer in the assembled position.

FIG. 5 illustrates the alignment of the primary and secondary blades 32,34 and the spacer 6. As shown the cutting edge 36 of the primary blade 32 is located forward of the cutting edge 38 of the secondary blade 34. The holes 42 in the blades 32,34 and the holes 41 in the spacer 6 align such that the water can flow from the lower surface 48 of the primary blade 32 to the upper surface 54 of the secondary blade 34. The water passage facilities the removal of shaving debris from the cutting edges 36,38 of the blades 32,34.

Figure 6:
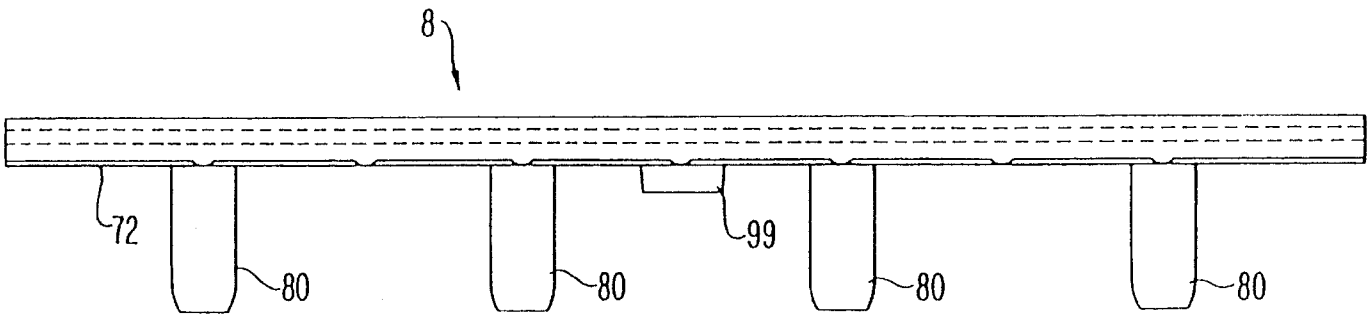
FIG. 6 illustrates a front view of a first embodiment of the cap member of the present invention.

The cap member 8 is disposed on the upper surface 54 of the secondary blade 34. As shown in FIG. 1 and 6, similar to the spacer 6, the lower surface 72 of the cap member 8 forms a cavity 76 which extends parallel to the cutting edge 36,38 of the blades 32,34. Also, the lower surface 72 of the cap member 8 comprises a plurality of downwardly extending pads 78 on the forward portion of the cap member 8. Again, similar to the spacer 6, the pads 78 are separated from one another so as to allow water to flow through the front of the cap member 8 into the cavity 76. As shown in FIG. 1, the secondary blade 34 extends beyond the downwardly extending pads 78 of the cap member 8, and therefore the pads 78 operate as a stop limiting the upward movement of the secondary blade 34.

In addition, the cap member 8 comprises a plurality of fastening means 80, such as rivets. The fastening means 80 extend downwardly from the lower surface 72 of the cap member 8 and pass through the securing apertures 44 of the spacer 6 and the securing apertures 40,43 of the blades 32,34 and into the securing apertures 30 of the blade seat 24. The ends of the fastening means 80 extend beyond the blade seat 24 and are upset thereby permanently affixing the blade seat 24, blades 32,34, spacer 6 and cap member 8 together.

FIG. 1 illustrates in detail the novel structure of the blade cartridge 10 of the present invention. As is apparent, the primary blade 32 is disposed on the upper surface 28 of the blade seat 24 with the cutting edge 36 extending over the slot 26 between the guard member 20 and the front wall 12 of the blade seat 24. The width of the blade seat 24 (i.e distance between the front and rear wall 12,14) and the width of the primary blade 32 is such that a substantial portion of the primary blade 32 extends over the slot 26.

The spacer 6 is disposed on the upper surface 50 of the primary blade 32. As shown in FIG. 1, one edge of the cavity 68 generally aligns with the front wall 12 of the blade seat 24 so as to form a vertical plane, thereby partially defining a flexing zone for the primary blade 32. The application of force upon the primary blade 32 causes the primary blade 32 to flex about the longitudinal axis in a downwardly direction. The downward movement of the primary blade 32 stops when the blade 32 engages the lips 60 formed on the support members 22. Thus, the distance the blade 32 is allowed to flex is defined by the height of the lip 60 relative to the upper surface 28 of the blade seat 24. The resiliency of the primary blade 32 returns the blade to the normal, horizontal position (as shown in FIG. 1) upon removal of the applied shaving force.

The secondary blade 34 is disposed on the upper surface 58 of the spacer 6 with the cutting edge extending over the opening 47 created between the forward portion 62 of the spacer 6 and the lower surface 52 of the secondary blade 34. Similar to the primary blade 32, the width of the rear portion 64 of the spacer 6 is such that a substantial portion of the secondary blade 34 extends over the opening 47.

The cap member 8 is disposed on the upper surface 54 of the secondary blade 34 such that one edge of the cavity 76 formed on the lower surface 72 of the cap member 8 generally aligns with beginning of the forward portion 62 of the spacer 6 so as to form a vertical plane. As shown in FIG. 1, the edge of the cavity 76 in conjunction with the sloping surface of the forward portion 62 of the spacer 6 partially defines the flexing zone for the secondary blade 34. As with the primary blade 32, the application of a force on the secondary blade 34 causes the blade 34 to flex about the longitudinal axis in the downwardly direction. The downward movement of the secondary blade 34 stops when the blade engages the ribs 66 formed on the upper surface 58 of the spacer 6. The resiliency of the secondary blade 34 returns the blade to the normal, horizontal position upon removal of the applied force.

As previously stated, the downwardly extending pads 70,78 of the spacer 6 and the cap member 8 prevent movement of the primary and secondary blades 32,34, respectively, in the upward direction beyond the horizontal position. It will be appreciated that as the portion of the primary and secondary blade 32,34 extending over the slot and opening 26,47, respectively, is reduced (i.e. as the flexing zone moves closer to the cutting edge), the flexibility of the blade will also be reduced. The flexibility of each blade depends upon factors including (1) the location of the flexing zone, (2) the thickness of the blade, and (3) the dimensions of the holes 42 in the blades (apertures 43 also contribute to the flexibility of the secondary blade). These factors can be adjusted so that the blades 32,34 flex when the applied force exceeds a predetermined level.

Figure 11:
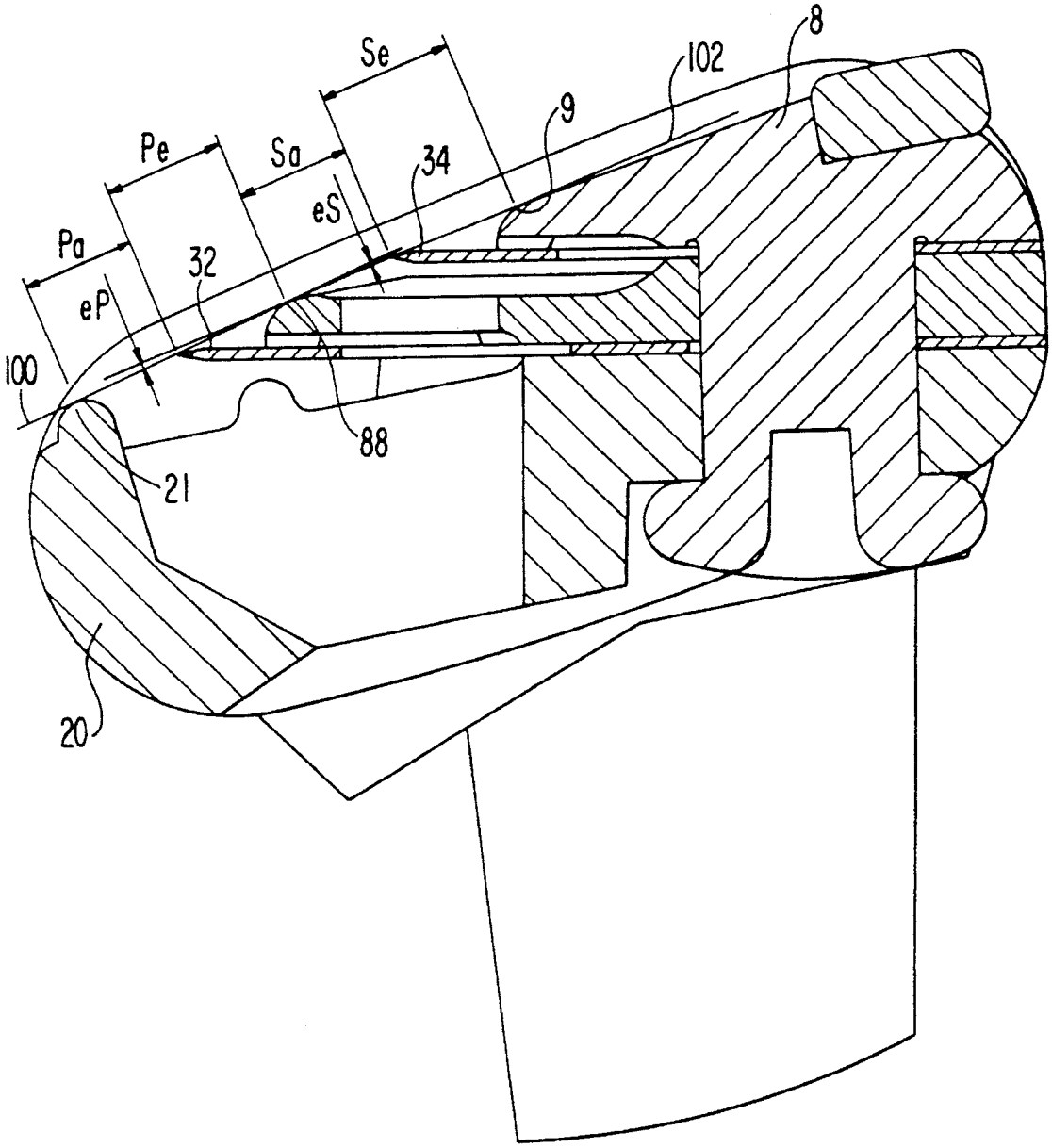
FIG. 11 is the same cross-sectional view of the blade cartridge as shown in 1 illustrating the optimum geometric relationships of the various components with the blades at rest.

In order to maximize shaving comfort and closeness, and minimize the potential for nicks and cuts, the blade exposure and shaving angle of the primary and secondary blades 32,34 are preset to the "at-rest" positions shown in FIG. 11.

More specifically, referring to FIG. 11, the shaving plane of the primary blade 32, denoted by reference line 100, is defined by the plane tangent to the upper portion 21 of the guard 20 and the skin engaging portion 88 of the spacer 6. The shaving plane of the secondary blade 34, denoted by reference line 102, is defined by the plane tangent to the skin engaging portion 88 of the spacer 6 and the upper portion 9 of the cap 8. Thus, the skin engaging portion 88 of the spacer 6 functions to maintain the geometry of the primary blade 32 relative to the shaving surface by establishing a safe contact and control surface behind the primary blade 32. The skin engaging portion 88 of the spacer 6 also maintains the geometry of the secondary blade 34 relative to the shaving surface.

The blade exposure of the primary blade "eP" in the "at-rest" position ranges between −0.001 to 0.002 inches, with the preferred range being between 0.0008 to 0.0012 inches. The blade exposure of the secondary blade "eS" ranges between −0.001 to 0.003 inches, with the preferred range being between 0.0012 to 0.0019 inches.

The shaving angle of the primary blade, which is the acute angle between the plane tangent to the cutting edge 36 of the primary blade 32 and the shaving plane denoted by reference line 100, ranges from 22 to 28 degrees, with the preferred range being between 25.8 to 26.6 degrees. The shaving angle of the secondary blade, which is the acute angle between the plane tangent to the cutting edge 38 of the secondary blade 34 and the shaving plane denoted by reference line 102, ranges from 18 to 24 degrees, with the preferred range being between 21.0 to 22.4 degrees.

As stated previously, the separation between the primary and secondary blades 32,34 in the "at-rest" position is governed by the thickness of the spacer 6, which ranges from 0.020 and 0.050 inches. The preferred thickness of the spacer 6 is 0.030 inches.

FIG. 11 also illustrates the aperture ranges and edge separation for both the primary and secondary blades 32,34. First, the primary aperture is the distance from the upper portion 21 of the guard 20 to the cutting edge 36 of the primary blade 32 measured along the shaving plane 100. Referring to the figure, the primary aperture is denoted Pa and ranges from 0.025 to 0.045 inches, with the preferred aperture being 0.036 inches.

Similarly, the secondary aperture, which is denoted by Sa is the distance from the skin engaging portion 88 of the spacer 6 to the cutting edge 38 of the secondary blade 34 measured along shaving plane 102. The range of the secondary aperture is also 0.025 to 0.045 inches, with the preferred aperture being 0.036 inches.

Finally, the edge separation of the primary blade 32 is the distance from the cutting edge 36 of the primary blade 32 to the skin engaging portion 88 of the spacer 6 measured along the shaving plane 100. Referring to the FIG. 11, the edge separation of the primary blade 32 is denoted Pe and ranges from 0.048 to 0.123 inches, with the preferred aperture being 0.084 inches.

Similarly, the edge separation of the secondary blade 34, which is denoted by Se is the distance from the cutting edge 38 of the secondary blade 34 to the upper portion 9 of the cap 8 measured along shaving plane 102. The range of the secondary aperture is also 0.048 to 0.123 inches, with the preferred aperture being 0.048 inches.

The foregoing geometric dimensions concerning blade position operate to maximize both shaving comfort and the closeness of the shave, while at the same time minimizing the potential for nicks and cuts. This results, in part, from the skin engaging portion 88 of the spacer 6 which allows for an aggressive exposure of both the primary and secondary blades 32,34, while at the same time contributing to the prevention of nicks and cuts.

Figure 12:
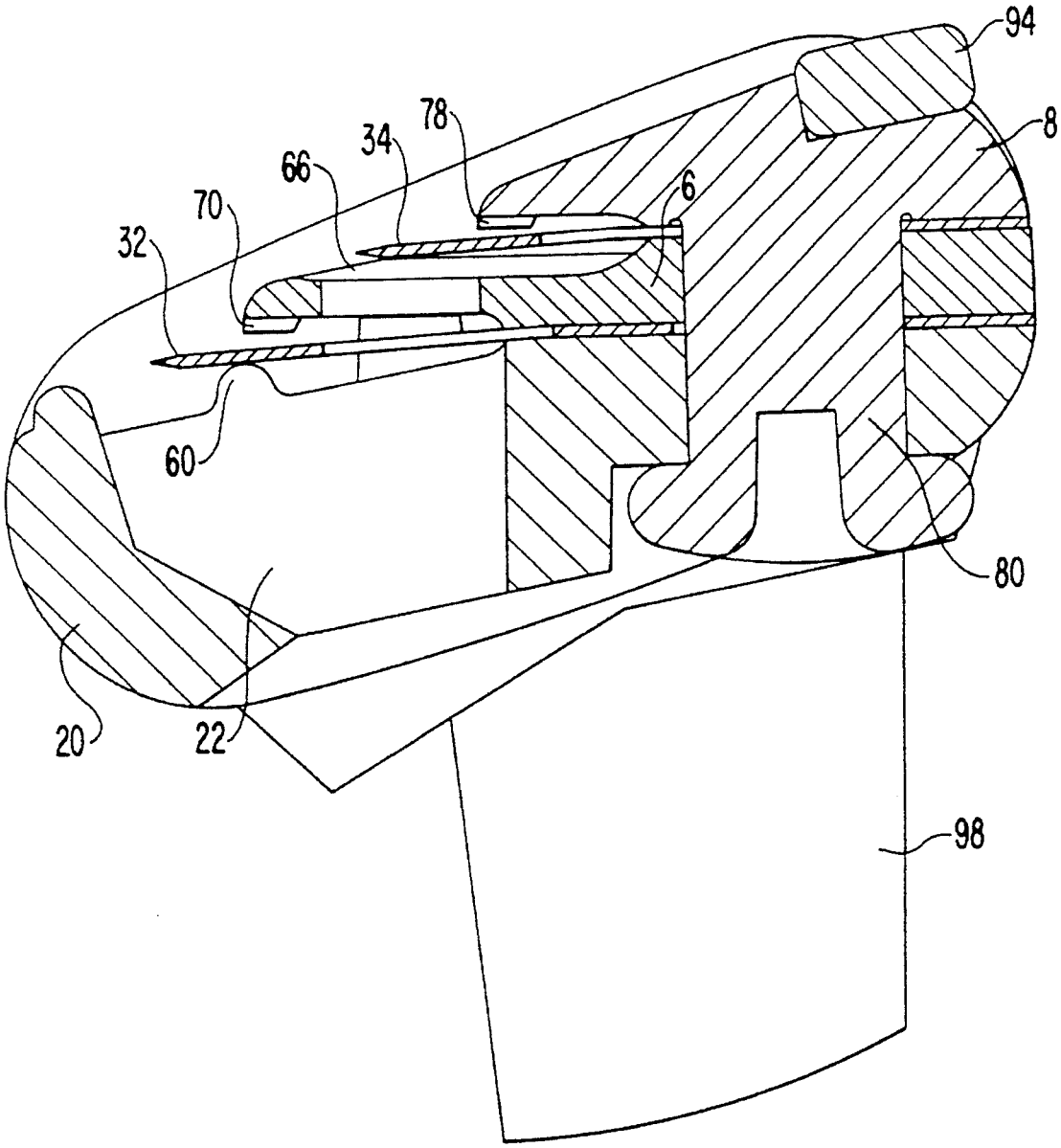
FIG. 12 is the same cross-sectional view of the blade cartridge as shown in FIG. 1 illustrating the blades fully flexed.

FIG. 12 illustrates both the primary blade 32 and the secondary blade 34 in the fully flexed position. As shown in FIG. 12, the downward movement of the primary and secondary blades 32,34 are limited by the lip 60 of the support member 22 and the ribs 66 on the spacer 6, respectively.

Figure 13:
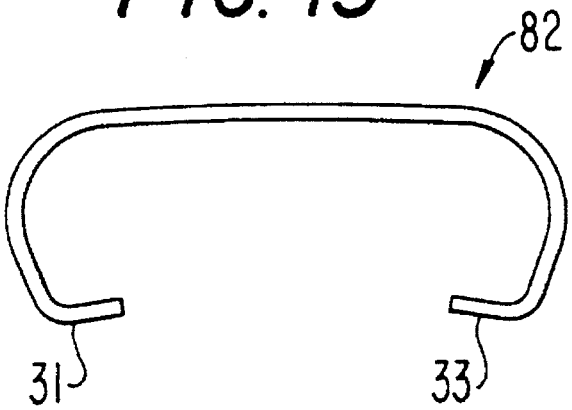
FIG. 13 illustrates a side view of an end clip.

In order to prevent the corners of the blades 32,34 from engaging the skin of the user, end clips 82 cover the outer edges of the primary and secondary blades 32,34. As shown in FIG. 13, each end clip 82 comprises a thin strip of material having a leg 31,33 on each end and is generally in a "C" shape. Each end clip wraps around the blade cartridge 10, whereby the legs 31,33 of each end clip are secured to the bottom of blade cartridge 10. Referring to FIG. 2, one end clip 82 is disposed in a slot 84 adjacent end 16. A second end clip 82 is disposed in a slot 86 adjacent end 18. Each end clip 18 runs perpendicular to the longitudinal axis of the blades 32,34 and covers the outer edges of the blades 32,34.

Furthermore, the end clips 82 which represent a significant portion of the skin engaging surface of the blade cartridge 10, are coated with a friction reduction agent so as reduce the drag forces associated with the blade cartridge 10 engaging the skin, thereby improving shaving comfort.

The friction reduction agent is applied to the end clips 82 prior to the end clips 82 being secured to the blade cartridge 10. Specifically, the friction reduction agent is applied in liquid form to the end clip, which can comprise, for example, an aluminum wire. The friction reduction agent is applied such that a thin film of the agent completely covers each end clip 82. The end clip 82 is then exposed to heat, or other appropriate means, so that molecules of the friction reduction agent crosslink with the molecules of the material of the end clip 82 to form a solid, thereby bonding the friction reduction agent to the end clip 82. The preferred range of the thickness of the friction reduction agent is between 0.0003 to 0.0005 inches. Multiple applications of the friction reduction agent are employed, if necessary.

While other friction reduction agents can be utilized, the preferred agent is polyvinyl acetyl (PVA). Some other acceptable agents include: nylon 515, polyimide, polyester imide, polyamide, polyester and teflon.

As a result of mounting the blades 32,34 in accordance with the present invention, there is no longitudinal movement of either the primary or secondary blade 32,34 relative to the remainder of the blade cartridge 10. Only rotational movement about the flexing zone associated with the each blade 32,34 is possible. More specifically, each blade 32,34 can only bend about the longitudinal axis of the blade within the flexing zone in a direction which reduces the blade exposure and shaving angle of the blade relative to a shaving surface. Furthermore, the primary and secondary blades 32,34 flex independently of one another.

For example, if the pressure encountered by the primary blade 32 exceeds the resilient force of the primary blade 32, the primary blade 32 bends in response to that force. Specifically, the primary blade 32 bends about the flexing zone, thereby causing the cutting edge 36 to move in a downward manner. Upon removal of the force, the primary blade 32 would return to the horizontal position as shown in FIG. 1. If an equivalent force were applied to the secondary blade 34, it would respond in a similar manner. Thus, the cutting edges 36,38 of the blades 32,34 move downwardly away from the shaving plane and adjust to a lower, safer shaving angle and blade exposure.

As illustrated in FIGS. 1 and 2, the guard member 20 placed in front of the primary blade 32 is integral with the ends 16,18 of the platform member 2 and is therefore stationary relative to the blade cartridge 10. Similar to the guard 20 being positioned in front of the primary blade 32, as shown in FIG. 5, the spacer 6 has a raised oval or round skin engaging portion 88, which provides an engaging surface to control exposure of the secondary blade 34 to the shaver's skin.

Figures 14, 15:
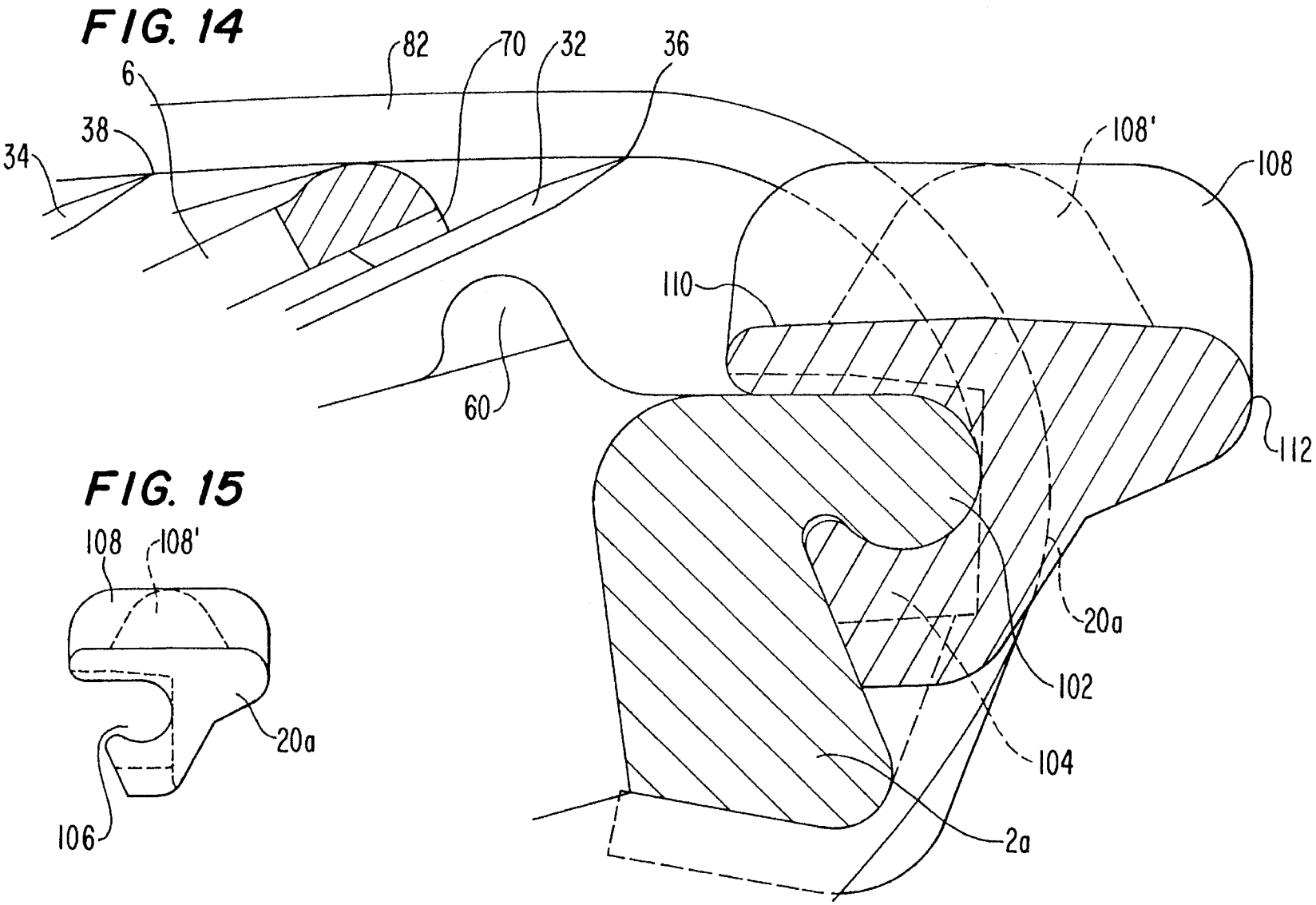
FIG. 14 illustrates a cross sectional view of a second embodiment of the present invention having a modified platform and guard member.
FIG. 15 illustrates a cross-sectional view of the modified guard member of FIG. 14.

FIG. 14 illustrates a second embodiment of the present invention in which both the front portion of the platform and the guard member are modified. (The unmodified features are indicated by the same numbers as utilized above). As shown in FIG. 14, in the second embodiment, the forward portion of the platform 2*a* is modified so as to comprise a first latch member 102 which extends outwardly from the forward edge of the platform 2*a*. In this embodiment, the first locking member 102 exhibits a substantially circular shape. As explained below, the first locking member 102 functions to retain the guard member 20*a* to the platform 2*a*.

The guard member 20*a*, which in this embodiment is formed separately from the platform 2*a*, comprises the second locking member 104 which couples with the first locking member 102 on the platform 2*a* so as to retain the guard member 20*a* to the platform 2*a*. As shown in FIGS. 14 and 15, the second locking member 104 comprises a substantially circular opening 106 which snaps on the first locking member 102, thereby securing the guard member 20*a* to the platform 2*a*. The first locking member 102 and the second locking member 104 extend substantially the entire length of the platform 2*a* and guard member 20*a*, respectively. Of course, locking members 102,104 having shapes different from those illustrated herein are also possible.

Figures 16, 17:
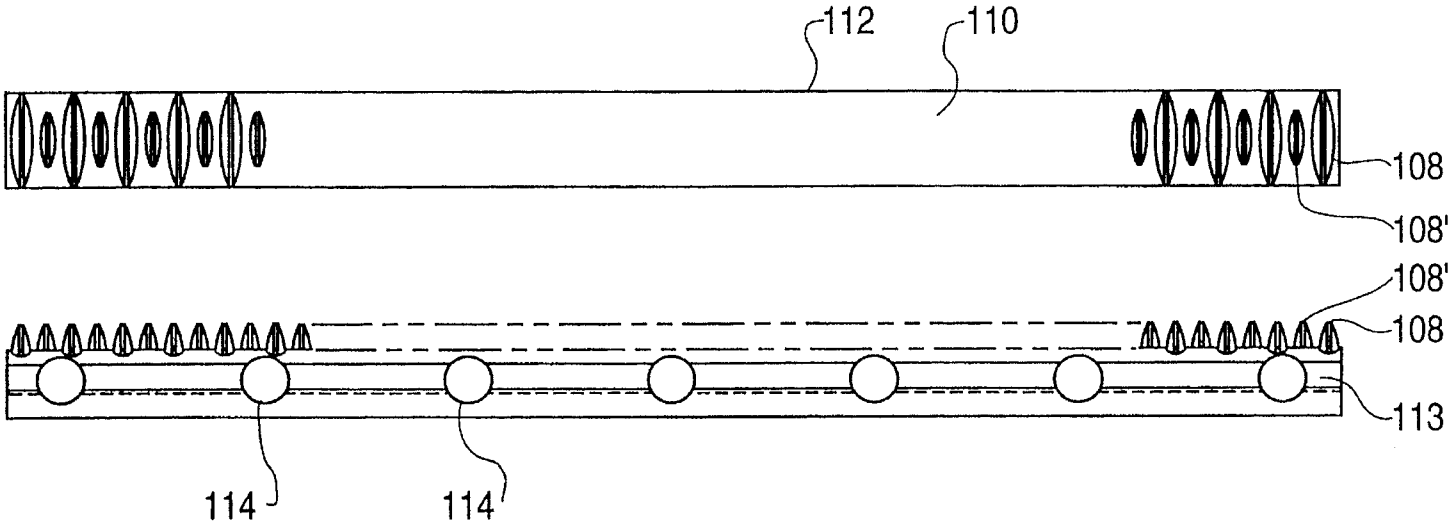
FIG. 16 illustrates a top view of the modified guard member of FIG. 14.
FIG. 17 illustrates a rear view of the modified guard member of FIG. 14.

Turning to FIGS. 15–17, the upper surface 110 of the guard member 20*a* includes a conditioning bar comprising a plurality of raised protrusions 108,108'. The protrusions 108,108' extend perpendicularly to the cutting edge 36,38 of the blades 32,34. The protrusions 108,108' perform a multitude of functions including applying tension to the skin prior to cutting hair, setting up hair prior to cutting and allowing lubricants (e.g., shaving cream) to pass through the guard so as to remain on the shaving surface during the cutting process to further reduce shaving irritation. Each protrusion 108,108' is loaded along its length and will be virtue of its shape and the direction of the shaving force applied resist flexing. Typically, prior art devices contained guards which would simply bend the hair and "squeegee" off all lubricants prior to actual cutting of the hair.

In the embodiment illustrated in FIG. 16, the protrusions 108,108' have a substantially elongated oval shape, and extend perpendicularly to the front edge 112 of the guard 20*a*. Further, the protrusions 108,108' alternate between ones that extend across the entire upper surface 110 (e.g., protrusion 108) of the guard member 20*a* and those which extend only across a portion of the upper surface 110 of the guard member 20*a* (e.g., protrusion 108'). Each protrusion 108,108' has a height ranging from approximately 0.020 to 0.040 inches, and is separated from the adjacent protrusion by a range of approximately 0.020 to 0.060 inches. Taken along the rear view (see, FIG. 17), the width of each protrusion 108,108' is approximately 0.008 inches at the top of the protrusion, and widens on approximately a 12.5 degree angle to a base width of approximately 0.020 inches. The protrusions exhibit a height to base ratio ranging from approximately 3:1 to 1:1. Taken along the side view (see, FIG. 15) of the protrusion 108,108', the upper portion of each protrusion 108,108' exhibits a radius of approximately 0.02 R. While as shown in FIG. 17, taken along the rear view (see, FIG. 17) of the protrusion 108,108', the upper portion of each protrusion exhibits a radius ranging from approximately 0.03 to 0.05 R. As shown in FIG. 15, the overall height of the guard member 20*a* (including protrusions 108,108') is approximately 0.095 inches, while the overall width of the guard member 20*a* is approximately 0.100 inches.

Of course other variations are also possible. For example, each protrusion 108,108' can be made to extend across the entire upper surface 110 of the guard member 20*a*. Alternatively, multiple rows of protrusions 108 can be formed along the upper surface 110 of the guard member 20*a*. Furthermore, protrusions 108 having different height to base ratios can be utilized. The maximum spacing between protrusions is governed by the conformability of skin. A spacing of greater than 0.050 inches would likely increase the exposure of the primary blade.

The guard member 20*a* comprising protrusions 108,108' is formed as a unitary member comprising a single material, preferably a polypropylene material having an A Shore hardness of approximately 98 or greater. The guard member 20*a* comprising protrusions 108,108' can be formed by an injection molding process.

Of course the material utilized to form the guard member 20*a* and protrusions 108,108' must allow for the guard member 20*a* to snap on the first locking means 102 of the platform 2*a*, and must be rigid enough to retain the guard member 20*a* on the platform 2*a*. A general purpose polypropylene material having a melt flow of 4 can be utilized.

The guard member 20*a* further comprises a plurality of recesses 114 located of the rear surface 113. These recesses 114 allow pins in the ejection mold to eject the part from the opened mold half without fouling the locking profile. Without the recesses 114, the pins in the mold would require precise shaping and would themselves interlock with the part.

Figure 18:
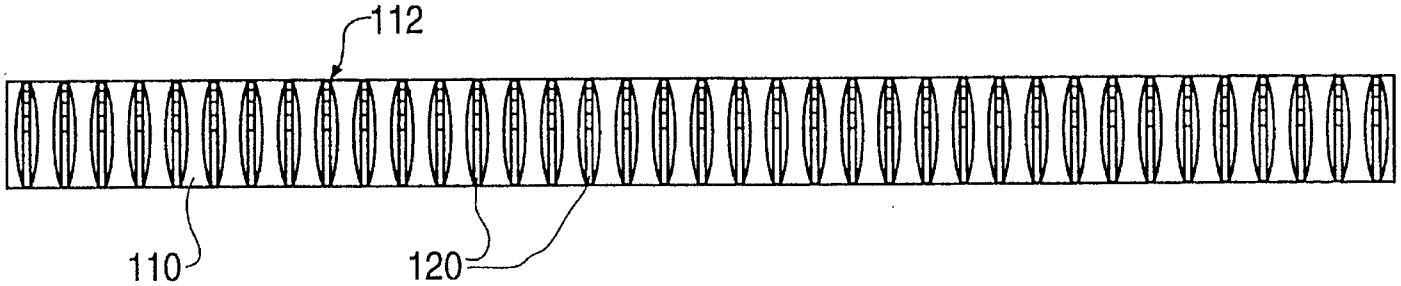
FIG. 18 illustrates a top view of a variation of the guard member illustrated in FIGS. 14–17.
Figure 19:
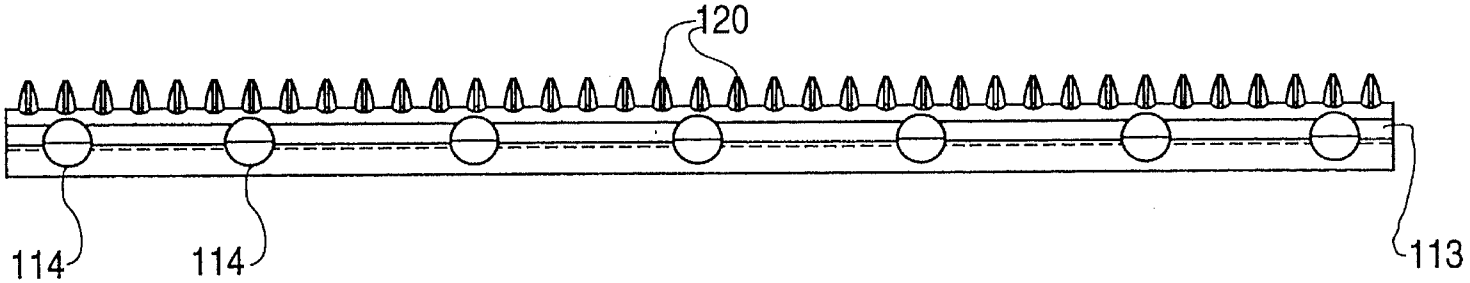
FIG. 19 illustrates a rear view of a variation of the guard member illustrated in FIGS. 14–17.

FIGS. 18–21 illustrates a variation of the conditioning bar disposed on the guard member 20*a* described in the second embodiment of the present invention. As shown in FIGS. 18 and 19, the protrusions 120 (i.e., conditioning bar) disposed on the upper surface 110 of the guard member 20*a* extend across substantially the entire upper surface 110. In this embodiment, each protrusion 120 is separated from the adjacent protrusion 120 by approximately 0.036 inches, and each protrusion 120 has a height of approximately 0.028 inches.

Figure 20:
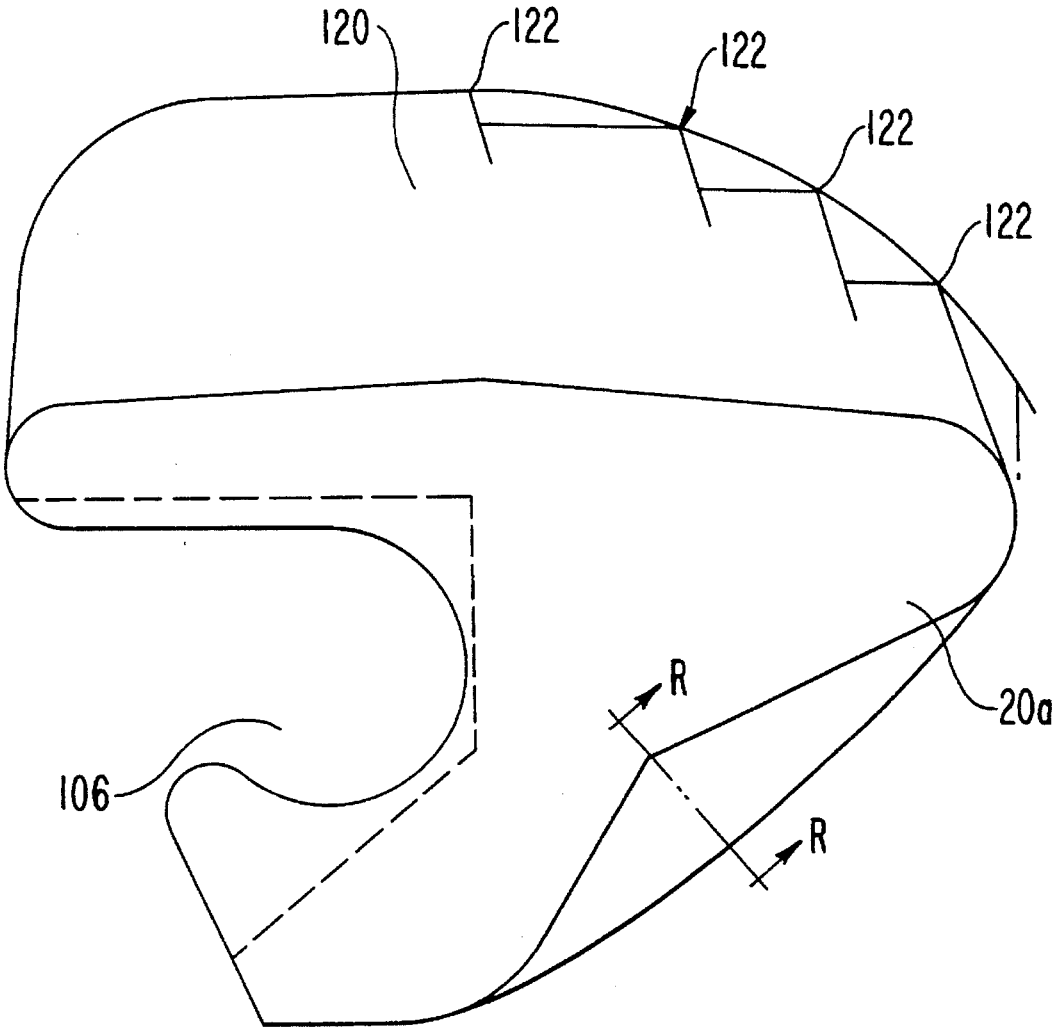
FIG. 20 illustrates a cross-sectional view of the guard member of FIG. 18.
Figure 21:
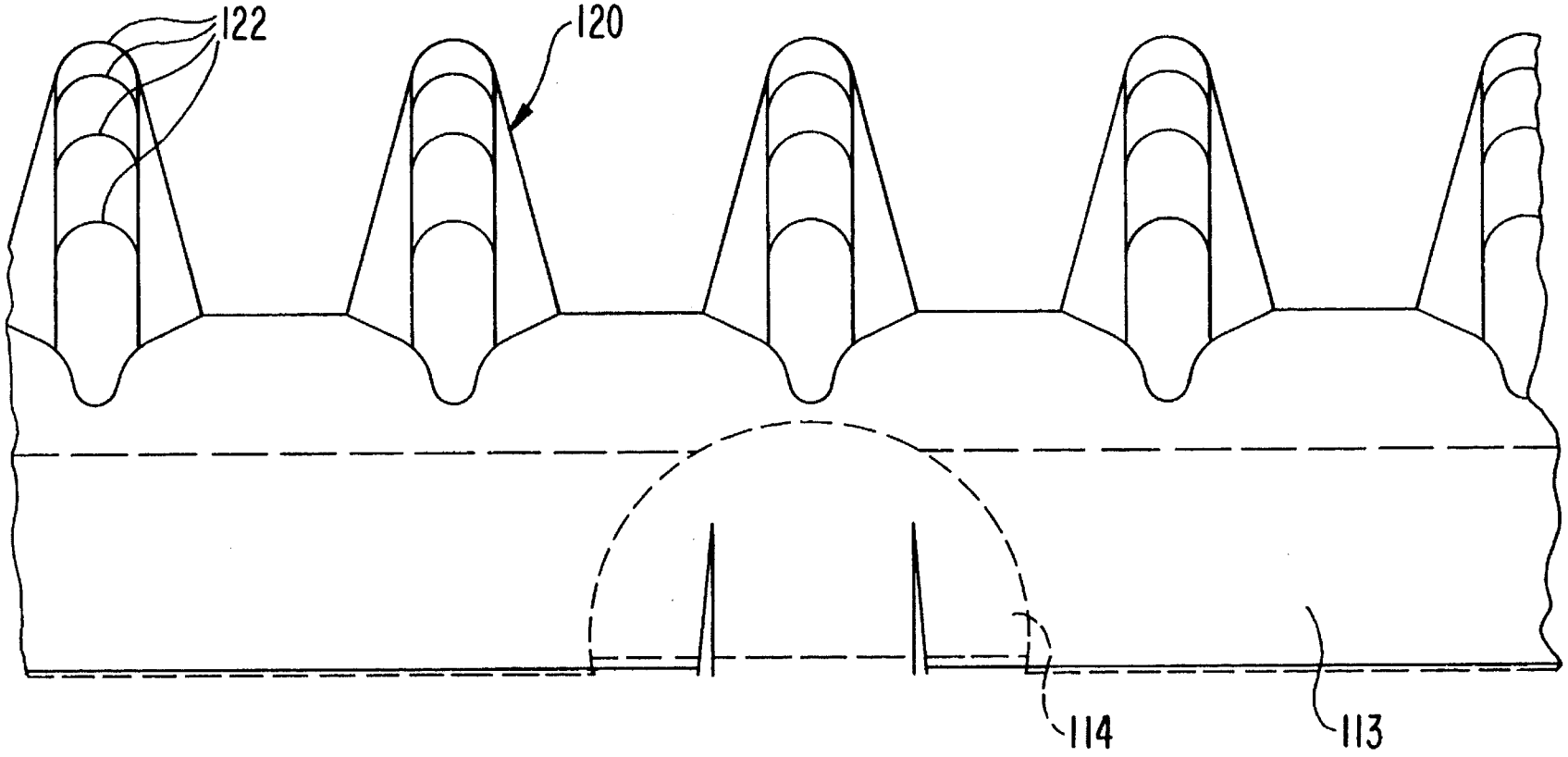
FIG. 21 is an enlarged illustration of a front view of a portion of the conditioning bar formed on the guard member of FIG. 18.

Furthermore, as best illustrated in FIG. 20, the forward edge of each protrusion 120 is contoured so as to form multiple skin engaging sites 122. Specifically, each of the skin engaging sites 122 comprises an edge which functions to increase the friction generated by the conditioning bar, thereby increasing skin tension during the shaving process. As a result, hairs will be projected further out of their associated follicle and will be cut below the skin line. As shown in FIG. 20, the skin engaging sites 122 of the present embodiment form a stair-like structure. Of course, other formations for generating the skin engaging edge can be utilized. The condition bar of the present embodiment comprises approximately 37 protrusions 120, each of which comprises 4 skin engaging sites 122. FIG. 21 is an enlarged illustration of a front view of a portion of the conditioning bar formed on the guard member of FIG. 18.

As with the protrusions 108,108' of the second embodiment, protrusions 120 are positioned 90 degrees to the blade edges and engage the skin ahead of the first blade. The rear portion of the protrusions 120 collectively regulate the exposure of the first blade edge. All other aspects of protrusions 120 are the same as described above with regard to protrusions 108,108'.

As previously stated, the conditioning bar of the present invention allows for the passage of hair to the blades without the hair necessarily being bent over so as to take full advantage of the skin tensioning feature of the conditioning bar. In addition, lubricants applied to the skin are passed through to the blade edges, thereby providing a more comfortable shave with less nicking and irritation.

Variations on the embodiments described above are possible. In a first variation, the height of the lips 60 formed of the support members 22 may be varied so as to effect different bending patterns. For example, if the lips 60 on the support members 22 in the center of the platform member 2 are lower relative to the lips 60 on the support members located proximate the ends of the platform member 2, the primary blade 32 exhibit increases movement in the center of the blade. With regard to the secondary blade, the same changes can be effected by varying the height of the ribs 66 located on the upper surface 58 of the spacer 6.

Furthermore, numerous variations of the flexible blades 32,34 are possible. For example, each blade 32,34 may be tapered such that the thickness of the blade decreases in the direction of the forward portion of the blade. Also, each blade 32,34 can comprise a U-shaped channel in the forward portion of the blades, which functions to define the flexing zone for the blade 32,34. Finally, the additional holes can be added to the blades of the preferred embodiment to vary the flexibility of the blades 32,34.

In another variation, the blade means comprises a single blade positioned between the platform member 2 and the cap member 8. The operation and movement of the single blade is the same as either blade in the two blade embodiment. However, the forward portion of the cap member would be extended relative to the cap member of the two blade embodiment such that the single blade razor exhibits the correct shaving geometry.

Figure 7:
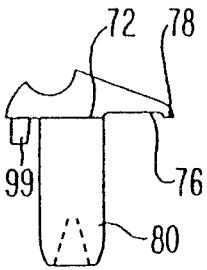
FIG. 7 illustrates an end view of the cap member shown in FIG. 6.

In another variation, as shown in FIG. 6 and 7, the cap member 8 further comprises a downwardly extending guide member 99 which functions to locate the secondary blade 34 in the desired position prior to permanently securing the cap member 8 to the platform member 2.

In another variation, the guard member 20 may include means to allow independent movement of the guard member 20 in the direction away from the direction of shaving forces acting upon the guard member 20. Jacobson U.S. Pat. Nos. 4,442,598, 4,378,634 and 4,270,268 disclose a blade cartridge having movable guard means.

Similarly, the cap member 8 may include means to allow independent movement in a direction away from the direction of shaving forces acting upon the cap member 8. Oldroyd et al., U.S. Pat. No. 4,063,354, discloses a shaving unit having a movable cap member 8 suitable for use with this invention.

In yet another variation, an additional shaving aid may be affixed or included with the blade cartridge 10. Typically, as shown in FIG. 1, the shaving aid comprises a polystyrene-polyethylene oxide blend in the form of lubricating strip 92, which may affixed to the upper surface 74 of the cap member 8 behind the secondary blade 34. During shaving, the polyethylene oxide leaches out of the styrene matrix. Other suitable shaving aids for use with the invention are also described in U.S. Pat. No. 4,170,821 issued to Booth entitled "Razor Cartridges." Preferably, the shaving aid comprises a matrix of polystyrene, polyethylene oxide and aloe and/or vitamin E. Also, the shaving aid 90 may define a lubrication strip 94, shown by dotted lines in FIG. 1, positioned near the guard member 20, either separately or in combination with the lubrication strip 92 located on the cap member 8.

In yet a further variation, the blade cartridge 10 may be permanently or detachably connected to a handle by suitable structures formed on the bottom surface of the blade cartridge 10. For example, the bottom surface of the blade cartridge 10 can be formed so as to attach to a handle in the manner described in U.S. Pat. No. 4,883,779 entitled PLATFORM, HANDLE AND SHIELD FOR SAFETY RAZOR, which issued to C. Iten and is hereby incorporated by reference.

Figure 10:
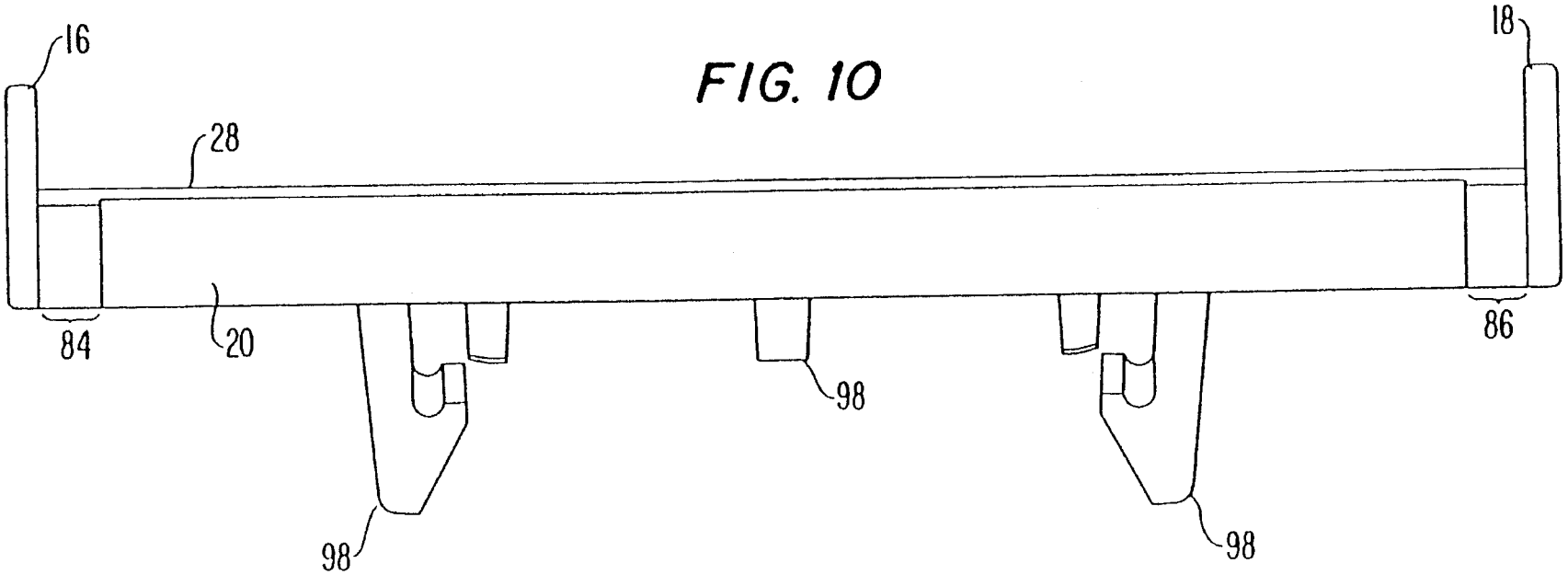
FIG. 10 illustrates one embodiment of the platform member adapted to receive razor handle so as to pivotally connect the blade cartridge to the razor handle.

Alternatively, the blade cartridge 10 can be mounted on a handle in such a manner that it pivots or is stationary while it is used to shave a surface. For example, as illustrated in FIG. 10, the bottom surface of the platform member 2 comprises mounting members 98 which allow the blade cartridge 10 to be pivotally mounted to a handle.

Still further, it is within the spirit of this invention to detachably connect the blade cartridge 10 to a handle, such as in U.S. Pat. No. 4,026,016 entitled RAZOR BLADE ASSEMBLY, issued to Warren I. Nissen, which is incorporated herein by reference.

In another variation, the upper and lower surfaces 58,56 of the rear portion 64 of the spacer 6 comprises a plurality of channels so as to allow shaving debris to be led out the back of the blade cartridge 10. Conversely, water can be directed into the back of the blade cartridge 10 to be channeled out through the front of the blade cartridge 10 and the edges 36,38 of the blades 32,34.

In another variation, the downwardly extending pads 70,78 located on the spacer 6 and the cap member 8 are replaced by a single downwardly extending pad which is parallel to the cutting edges of the blades and has a length at least equal to the length of the blades.

The embodiments described above provide a number of significant advantages. The use of a blade which is flexible about the longitudinal axis of the blade within a body portion of a blade cartridge or the like precisely controls blade geometry in response to shaving forces. Any flexing of the blade results in the simultaneous reduction of both critical safety dimensions, blade exposure and shaving angle.

Furthermore, the optimized geometric relationships between the various components of the blade cartridge as disclosed by the present invention provide for maximum comfort and closeness, while simultaneously minimizing the potential for nicks and cuts.

As yet another advantage, the blade cartridge of the present invention, simplifies the manufacturing process for creating blade cartridges. The present invention eliminates the need for creating an injection mold comprising a plurality of thin, individual spring fingers or leaf springs or the like.

In addition, the use of end clips coated with a friction reduction agent provide for a significant reduction in the drag forces associated with the shaving process so as to provide a more comfortable shave.

Of course, it should be understood that a wide range of changes and modifications can be made to the preferred embodiment described above. It is therefore intended that the foregoing detailed description be understood that it is the following claims, including all equivalents, which are intended to define the scope of this invention.

What is claimed is:

1. A flexible blade cartridge comprising a platform member defining a guard member and a cap member, a spacer and a blade means, wherein, said blade means comprises a blade a forward and rearward section, said forward portion of said blade being flexible to a less aggressive position in response to applied shaving forces, said blade being flexible about its longitudinal axis, said rearward section of said blade permanently fixed between said guard member and said cap member, said guard comprising a plurality of protrusions extending upwardly from an upper surface of said guard member, each of said protrusions having a longitudinal axis which extends substantially perpendicular to a front edge of said guard member, and each of said protrusions having a substantially elongated oval shape.

2. A flexible blade cartridge according to claim 1, wherein said plurality of protrusions are aligned to form a single row, said protrusions having substantially the same height.

3. A flexible blade cartridge according to claim 2, wherein each of said protrusions are approximately 0.020 inches to 0.060 inches apart from an adjacent protrusion.

4. A flexible blade cartridge according to claim 1, wherein said plurality of protrusions are aligned to form a plurality of rows, said protrusions having substantially the same height.

5. A flexible blade cartridge according to claim 1, wherein said guard member and said plurality of protrusions are formed as a single unitary member comprising a single material.

6. A flexible blade cartridge according to claim 5, wherein said single material forming said guard member and said plurality of protrusions is a polypropylene material.

7. A flexible blade cartridge according to claim 1, wherein said platform member comprises a first locking means, said guard member comprises a second locking means, said first and second locking means operating to secure said guard member to said platform member.

8. A flexible blade cartridge according to claim 1, wherein each of said plurality of protrusions comprises a plurality of skin engaging sites.

9. A flexible blade cartridge according to claim 8, wherein each of said skin engaging sites comprises an edge which functions to increase skin tension during the shaving process.

10. A flexible blade cartridge comprising a platform member defining a guard member and a cap member, a spacer and a blade means, wherein, said blade means comprises a blade a forward and rearward section, said forward portion of said blade being flexible to a less aggressive position in response to applied shaving forces, said blade being flexible about its longitudinal axis, said rearward section of said blade permanently fixed between said guard member and said cap member, said guard comprising a plurality of protrusions extending upwardly from an upper surface of said guard member, each of said plurality of protrusions comprising a plurality of skin engaging sites, each of said protrusions having a longitudinal axis which extends substantially perpendicular to a front edge of said blade, and each of said protrusions having a substantially elongated oval shape.

11. A flexible blade cartridge according to claim 10, wherein each of said skin engaging sites comprises an edge which functions to increase skin tension during the shaving process.

12. A flexible blade cartridge according to claim 11, wherein said plurality of protrusions are aligned to form a single row, said protrusions having substantially the same height.

13. A flexible blade cartridge according to claim 12, wherein each of said protrusions are approximately 0.020 inches to 0.060 inches apart from an adjacent protrusion.

14. A flexible blade cartridge according to claim 10, wherein said guard member and said plurality of protrusions are formed as a single unitary member comprising a single material.

15. A flexible blade cartridge according to claim 14, wherein said single material forming said guard member and said plurality of protrusions is a polypropylene material.

16. A flexible blade cartridge according to claim 15, wherein said platform member comprises a first locking means, said guard member comprises a second locking means, said first and second locking means operating to secure said guard member to said platform member.

17. A flexible blade cartridge comprising a platform member defining a guard member and a cap member, a spacer and a blade means, wherein, said blade means comprises a blade a forward and rearward section, said forward portion of said blade being flexible to a less aggressive position in response to applied shaving forces, said blade being flexible about its longitudinal axis, said rearward section of said blade permanently fixed between said guard member and said cap member, said guard comprising a plurality of protrusions extending upwardly from an upper surface of said guard member, each of said plurality of protrusions has substantially a conical shape and exhibits a height to base ratio ranging from approximately 3:1 to 1:1.

18. A flexible blade cartridge comprising a platform member defining a guard member and a cap member, a spacer and a blade means, wherein, said blade means comprises a blade a forward and rearward section, said forward portion of said blade being flexible to a less aggressive position in response to applied shaving forces, said blade being flexible about its longitudinal axis, said rearward section of said blade permanently fixed between said guard member and said cap member, said guard comprising a plurality of protrusions extending upwardly from an upper surface of said guard member, said protrusions having substantially the same height and aligned to form a single row, said protrusions alternating between protrusions that extend across the entire upper surface of said guard member and protrusions that extend only across a portion of the upper surface of said guard member.

* * * * *